US008852009B2

(12) United States Patent
Culleton et al.

(10) Patent No.: US 8,852,009 B2
(45) Date of Patent: Oct. 7, 2014

(54) ACTIVITY SURFACES USING STRUCTURAL MODULES

(75) Inventors: Paul David Culleton, Warrington (GB); Andrew Bryan Shuttleworth, Poulton-le-Fylde (GB); Carolu Hermanus Van Raam, Hoogmade (NL); David Saxby, Melton Mowbray (GB); William Pomfret, Preston (GB)

(73) Assignee: Permavoid Limited, Warrington (GB)

( * ) Notice: Subject to any disclaimer, the term of this patent is extended or adjusted under 35 U.S.C. 154(b) by 163 days.

(21) Appl. No.: 13/383,828

(22) PCT Filed: Jul. 13, 2010

(86) PCT No.: PCT/GB2010/001331

§ 371 (c)(1),
(2), (4) Date: Mar. 19, 2012

(87) PCT Pub. No.: WO2011/007127

PCT Pub. Date: Jan. 20, 2011

(65) Prior Publication Data

US 2012/0178542 A1 Jul. 12, 2012

(30) Foreign Application Priority Data

Jul. 13, 2009 (GB) ..... 0912173.2

(51) Int. Cl.

| | |
|---|---|
| ***A63C 19/10*** | (2006.01) |
| ***E01C 3/00*** | (2006.01) |
| *E01C 13/02* | (2006.01) |

(52) U.S. Cl.

CPC ..... *E01C 13/02* (2013.01); *E01C 3/006* (2013.01)

USPC ..... 472/92; 472/94

(58) Field of Classification Search

USPC ..... 472/85–92, 136; 405/27–29, 34, 40, 43, 405/45

See application file for complete search history.

(56) References Cited

U.S. PATENT DOCUMENTS

| | | | | |
|---|---|---|---|---|
| 5,514,722 | A | 5/1996 | Di Geronimo | |
| 8,555,586 | B2 * | 10/2013 | Lowe et al. | 52/310 |

FOREIGN PATENT DOCUMENTS

| | | | |
|---|---|---|---|
| GB | 2395135 | A | 5/2004 |
| NL | 2000502 | C1 | 8/2008 |
| WO | WO02/14608 | A1 | 2/2002 |
| WO | WO2009/030896 | A1 | 3/2009 |

OTHER PUBLICATIONS

PCT International Search Report, PCT International Application No. PCT/GB2010/001331 dated Aug. 26, 2011.

* cited by examiner

*Primary Examiner* — Kien Nguyen
(74) *Attorney, Agent, or Firm* — McDonnell Boehnen Hulbert & Berghoff LLP

(57) ABSTRACT

An area suitable for sporting activities comprises an upper synthetic surface layer, and a sub-surface support layer which includes a load bearing structural module. The structural module comprises a top wall and a bottom wall spaced therefrom by one or more supporting elements so as to define a volume between the top and bottom walls. The top wall is provided with a plurality of apertures to permit the flow of liquid into and out of the volume. The size and shape of the apertures is such that the apertures cause substantially no variation in the flatness of the synthetic surface layer.

25 Claims, 12 Drawing Sheets

ACTIVITY SURFACES USING STRUCTURAL MODULES

CROSS REFERENCE TO RELATED APPLICATIONS

The present application is a national stage entry of PCT/GB2010/001331, filed Jul. 13, 2010, and claims priority to GB 0912173.2, filed Jul. 13, 2009. The full disclosures of GB 0912173.2 and PCT/GB2010/001331 are incorporated herein by reference.

This invention relates to structures for areas suitable for various activities such as sports. For example, the area may be an artificial sports area, for sports such as hockey or football for example, in which players can train or take part in competitive activities. In particular, the invention relates to arrangements in which an upper artificial surface layer is supported by a sub-surface layer.

Many official sporting bodies have stringent requirements regarding how level (i.e. horizontal) and how flat (i.e. not bumpy or uneven) a playing area must be in order that it can be used for officially recognised competitions. Even if a surface is not to be used for such competitions, it is generally desirable for it to be as flat and level as possible so that it does not adversely affect the trajectory of a ball rolling over the surface, and/or to provide an even surface for player to run on.

As an example of an official sporting body's requirements, the International Hockey Federation requires that the following criteria be met for an artificial pitch to be certified for use in international competitions:

after rolling down a standard inclined plane or ramp, a ball must roll 9 m to 15 m with a maximum deviation of 3° from the straight line;

the longitudinal slope of the pitch must be less than 0.2%;

the lateral slope of the pitch must be less than 0.4%;

the maximum deviation of the surface above or below a three meter long planimeter or straight edge laid in any direction must be less than 6 mm; and there must be no significant height difference and no gaps or separation at joints and seams. The maximum tolerance for both height and gaps or separation is 2 mm.

In addition, a hockey ball dropped vertically from a height of 2 m (measured to the underside of the ball) onto the pitch must achieve a mean rebound height between 100 mm and 400 mm, and the mean force reduction values of the pitch must be between 40% and 65%.

In order to provide flat and level playing surfaces, it is known to provide a surface with a pervious or impervious macadam or similar (e.g. cementitious) layer located underneath a synthetic grass layer. The macadam or similar layer can provide a flat and level surface on which the synthetic grass layer can be laid. Macadam or similar is used because it can meet stringent level tolerances (such as those described above set down by the International Hockey Federation) that are often unachievable with alternatives such as solely granular layers or compacted earth, for example.

However, in such a surface the material beneath the macadam or similar layer must be sufficiently supported to allow, for example, the temporary trafficking of the surface by a laying plant for laying the macadam or similar layer evenly without affecting the flatness of the surface.

In order to achieve sufficient support for such a laying plant it is common practice to compact the existing ground to form a prepared formation, and to overlay the compacted formation with a granular sub-base layer. The formation has to be sufficiently compacted to allow the laying plant to traffic over the sub-base layer without excessive deflections or indentations being formed in the sub-base layer, as these would subsequently show up in the synthetic grass layer.

FIGS. 13, 14 and 20 illustrate such a known surface where a macadam layer 202 is located on top of the sub-base layer 203. Such surfaces also often comprise a shock pad layer 201 located between the macadam or similar layer 202 and the synthetic grass layer 200, as shown in FIG. 20, and a geotextile or geogrid or similar filter layer 204 located beneath the sub-base layer 203, which allows water to pass through. Generally, the macadam or similar layer 202 is also water permeable to allow the surface to drain and/or water to pass up into the layer 202 from beneath, where the sub-base layer is being used as part of a water management system e.g. for temporary attenuation Beneath the geotextile or similar filter layer 204, there may be a granular filter media layer 205, a perforated land drain 206 and either an impermeable membrane 207, which prevents water from passing into the ground formation 208, or a further geotextile filter layer 209, which allows water to pass down out of the surface into the ground formation 208 below.

It is usually important to ensure that the upper layers of the artificial surface are sufficiently drained and this is commonly achieved by using either sub-surface drainage (if the upper surface is pervious to water) and/or by introducing surface level drainage systems such as channels, usually located around the perimeter of the surface.

Where water-pervious artificial surfaces are used, it is important that the sub-base is drained and this is usually achieved by introducing perforated drainage pipes 206 beneath the sub-base layer 203 and/or by forming the sub-base from open-graded granular material 205 that can drain vertically and laterally. It is also known that the open graded sub-base layer 205 can additionally be used to temporarily store surface water run-off as part of a water management system.

Whatever type of drainage system is used, it is generally still necessary to provide a machine-laid macadam layer 202 in order to ensure that the surface onto which the synthetic grass layer 200 is placed is sufficiently flat and level.

However, one of the main problems with such a surface relates to the overall settlement resistance of the sub-base layer 203. The surcharge loading produced by the granular sub-base layer 203 and the temporary loading imparted by a macadam laying plant used to lay the macadam layer 202 on top of the sub-base layer 203 can cause irregularities in the surface level.

Using a macadam laying plant generally necessitates an increased amount of preparation of the formation layer 208 beneath the sub-base layer 203 to ensure that the temporary plant loadings do not create localised differences in settlement within the sub-base layer 203. Such preparation typically needs to achieve a CBR (California Bearing Ratio) value of 5%. If such preparation is not achieved, any differences in the settlement of different areas of the sub-base layer 203 would subsequently be reflected in, or passed into, the finished upper surface layer (i.e. the synthetic grass layer 200). This could potentially cause the completed system to be out of level tolerance and unfit for purpose.

These settlement and surcharging issues can be especially problematic where artificial pitches are located on ground that has abnormal engineering issues, for example:

soils that are difficult to compact, e.g. saturated silts;

soils that are highly compactable, e.g. peat;

soils that are contaminated and upon compaction may 'squeeze out' contaminants; and/or soils that are within a high (near surface) water table area.

As mentioned above, alongside the general functional requirements of an artificial pitch or sports surface, some surfaces also comprise a storm or rain water management system. In such instances, the sub-base layer 203 is used to drain, convey and/or store surface water run-off. A pre-requisite for effectively achieving these additional functions is the need for the sub-base layer 203 to be sufficiently permeable to ensure that the surface can drain effectively and that water can migrate vertically and ideally also horizontally through it.

However, one of the problems in achieving efficient and effective water management with traditional granular sub-base layers 203, is the relatively low permeability of granular layers and the relative inconsistency of granular layers, which, by their nature, are generally formed from random stones that have undergone a degree of processing and grading.

Furthermore, the granular sub-base layers 203 that are used for drainage and attenuation purposes generally need to be uniformly graded in order to introduce higher void ratios and this exacerbates the level control in placing the material as the individual stones are easily displaced from each other like marbles.

Another problem associated with sourced aggregates used in such sub-base layers is the immense cost variability depending on location, resulting from the exacting performance of the material, the geographical location of the source and the variable cost of mineral extraction.

In addition there is a continuing drive from a sustainability and environmental perspective to minimise the use of primary aggregates to reduce quarrying and its associated negative environmental impacts.

In view of the above problems, it is therefore desirable to provide a surface which does not necessitate the use of a sub-base layer 203 as used in the prior art.

The present invention is concerned with a new surface which provides an improved surface for, in particular, sporting activities.

In the field of construction generally, it is known from WO 02/14608 to form a sub-surface layer from a structural module instead of traditional particulate materials such as natural aggregate or sand.

The preferred module is cuboid in form, and may, for example, be moulded from strong plastics. In a preferred arrangement each module is formed from a top half which includes a top wall and the upper part of a peripheral sidewall, and a bottom half defining a bottom wall and the lower part of the peripheral sidewall.

The top and bottom halves may each be provided with a set of half-pillars extending towards one another, the two sets of half-pillars co-operating with one another to form pillars extending between the top and bottom walls to resist vertical and lateral crushing of the module. The top and bottom halves may be two integral plastics moulded components which are fitted one inverted on top of the other.

Preferably, the module further comprises a network of bracing members extending between the pillars within the module to resist deformation of the module in a horizontal plane. In the preferred arrangement the walls and network have apertures formed therein to allow water to flow both vertically downwards and horizontally through the module, for drainage purposes. However, the apertures formed in the top wall of the modules are relatively large and, if a synthetic grass layer, optionally in combination with a shock pad layer, were placed on top of these modules, the shape of the aperture would impress itself into the synthetic grass layer, creating a surface that was uneven and unsuitable for use in cases where the surface must be flat and level.

One aspect of the present invention relates to the provision of modules in a sub-surface support layer for providing a substantially flat and level surface.

Thus, viewed from one aspect, the invention provides an area suitable for sporting activities, comprising an upper synthetic surface layer, and a sub-surface support layer which includes a load bearing structural module, wherein the structural module comprises a flat top wall and a bottom wall spaced therefrom by one or more supporting elements so as to define a volume between the top and bottom walls, the top wall being provided with a plurality of apertures to permit the flow of liquid into and out of the volume, and the size and shape of the apertures being such that the apertures cause substantially no variation in the flatness of the synthetic surface layer.

As the module has apertures in its upper wall, water can drain from the upper synthetic surface layer into the structural module below, thereby preventing the upper synthetic surface layer from becoming excessively wet.

Furthermore, as the size and shape of the apertures is such that they cause substantially no variation in the flatness of the synthetic surface layer, the synthetic surface layer can lie flat on top of the module and strict level tolerances of sport surfaces can be met without need for the macadam and sub-base layers of the prior art and their associated disadvantages.

Due to the structure of the present invention, it will not always be necessary to dig into the earth first before laying the surface. It may be possible to simply lay the structural module directly on the ground, provided of course that it is sufficiently flat.

The present invention can provide a surface which is sufficiently flat without the need for the granular sub-base and macadam layers used in the prior art. Due to the use of one or more structural modules, in place of the granular sub-base and macadam layers used in the prior art, the present invention can be considerably lighter than the prior art solution and therefore exerts considerably less force on the ground beneath. This is beneficial because the land beneath is therefore less likely to move and cause irregularities in the flatness and level of the upper surface. It also means that if the land beneath contains any impurities or contaminants, these are less likely to be "squeezed" out into the surrounding earth or the surface above.

Furthermore, due to the reduction in weight, the present invention can involve significantly (e.g. up to 100 times) less transportation costs than the prior art, which is both a cost and an environmental benefit.

In use, the top wall of the structural module should ideally define a plane which is substantially flat and horizontal.

The size and shape of each aperture in the top wall of the module is preferably such that the aperture would let through a sphere only with a diameter of no greater than about 5 mm, or no greater than about 6 mm, or no greater than about 7 mm, or no greater than about 8 mm, or no greater than about 9 mm, or no greater than about 10 mm, or no greater than about 12 mm, or no greater than about 15 mm. Preferably, the aperture will let through a sphere only with a diameter which is no greater than a specified diameter in the range of about of 5 mm to about 10 mm. The specified diameter could for example be any one of the diameter values in the range of 5 mm to 10 mm, in 0.5 mm increments, such as 5, 5.5, 6 mm . . . and all 0.5 mm incremental values to . . . 9, 9.5, and 10 mm. In a preferred embodiment, a sphere with a diameter of about 7 mm cannot fit through each aperture in the top wall.

A top wall with apertures of such sizes and shapes as described above can ensure that that shape of the apertures is not impressed into the upper synthetic surface layer.

The structural module should preferably be sufficiently strong that it can support any anticipated loads (e.g. from players) without breakage. In addition, the modules should ideally be stiff enough to run on (i.e. without significant deformation).

However, in some cases the structural module may be allowed to deform slightly under a load and thereby provide a slight cushioning effect.

Preferably, the apertures in the top wall are formed by a mesh-like structure of connected members. The members may have varying thicknesses, i.e. some may be thicker than others in order to provide additional strength.

The apertures in the top wall may be of any shape.

The aperture to total area ratio of the top wall may be at least 40%, 50%, 55%, 60%, 65%, 70%, 75%, 80%, 85% or 95%. Such relatively high ratios ensure that water can pass quickly and easily from the upper synthetic surface layer into the structural module below. Preferably, the aperture to total area ratio of the top wall is at least 60%.

The upper synthetic layer may comprise synthetic grass, for example. The grass could be provided in a carpet-like structure formed from fibres comprising polymer material, a filler such as sand and/or rubber granules, and a binder Some official sporting bodies (e.g. for rugby) have requirements known as "Peak g" requirements ("Peak g" being the deceleration of a body or object on impact with a surface), whereby it is necessary for a playing surface to have a certain level of cushioning to prevent players from incurring significant injuries if they fall. For example, some bodies require a "Peak g" or peak deceleration value of 200 g (g being the acceleration due to gravity). This can be particularly important in sports such as rugby where a player may fall and his head may come into contact with the surface.

In some cases sufficient cushioning may be provided by the upper synthetic surface layer and/or the structural modules and/or other parts of the surface. However, in cases where sufficient cushioning is not provided by these parts, or if additional cushioning is desired, then a separate cushioning layer, such as a shock pad, can be used.

This cushioning layer may be provided between the upper synthetic layer and the sub-surface support layer.

The shock pad or cushioning layer could be made of foam, for example. Alternatively, it could be made from synthetic or actual rubber. This could be in the form of granules which could be bonded together to form a layer. The rubber could come from old tyres, for example.

If the shock pad is formed from a layer of bonded rubber granules, then the apertures should be of a size to prevent the granules from passing through. The apertures could be of a size such that the granules can "sit" in the apertures, gripping the structural module and thereby holding the shock pad in place. Any granules used must be sufficiently small that they do not lead to any significant indentations visible in the upper surface of the upper synthetic surface layer.

Preferably, if a cushioning layer is used then it should be water-permeable so that water can still pass from the upper synthetic surface layer to the structural modules below. For example, water-permeability could be achieved by providing one or more, preferably small, holes in the cushioning layer. Of course, any holes must be sufficiently small that they do not lead to significant indentations visible in the upper surface of the upper synthetic surface layer.

In general, sport surfaces should ideally be hard enough to run on (i.e. have sufficient force reduction on impact) but soft enough that injury is not incurred on impact (i.e. provide some cushioning). These opposing requirements often lead to the requirement of a sport surface having a force reduction factor in the range of 40-65%. This can be attained by providing structural modules with an appropriate stiffness, and possibly a further cushioning layer, as described above.

The bottom wall of the module may also have at least one aperture to permit the flow of liquid therethrough. However, it is not necessary that the size and shape of this aperture be limited in the same way as the apertures in the top wall. The aperture or apertures in the bottom wall of the module can allow water in the module to drain out of the module into the ground or further sub-surface layers below.

Preferably, any apertures in the bottom wall are larger, preferably substantially larger, than those in the top wall in order to allow water to pass through more easily. For example, a sphere with a diameter which exceeds the maximum diameter allowable for spheres to be able to pass through an aperture in the top wall, may be able to pass through an aperture in the bottom wall.

Preferably, the module comprises at least one side wall extending between the top and bottom walls, and acting as a supporting element.

The side wall may have at least one aperture to permit the flow of liquid therethrough. As with any apertures in the bottom wall, it is not necessary that the size and shape of any apertures in the side wall or walls be limited in the same way as the apertures in the top wall. Apertures in side walls can allow water to pass laterally through the surface.

Preferably, any apertures in the side wall are larger, preferably substantially larger, than those in the top wall in order to allow water to pass through more easily.

For example, a sphere with a diameter which exceeds the maximum diameter allowable for spheres to be able to pass through an aperture in the top wall, may be able to pass through an aperture in the side wall. As most surfaces will cover relatively large areas (e.g. the size of a sports pitch), preferably a plurality of modules are contained within the surface such that the whole area may be covered. Such a plurality of modules should ideally be arranged laterally such that their top walls lie in a common horizontal plane.

It is also possible that more than one layer of structural modules could be provided. If so, any apertures in the top walls of modules not in the top layer would not have to meet the size and shape requirements of those in the top layer, although for practical reasons it may be simpler to manufacture them to the same design as modules in the top layer.

Where a plurality of modules are provided, any apertures in a side wall or side walls of the modules may allow water to pass laterally from module to module.

A geotextile or similar layer may be provided above and/or below the structural module. This geotextile or similar layer should preferably be water-permeable but can prevent particles from other layers (e.g. sand or rubber from the synthetic surface layer) from passing into the structural module. The geotextile or similar layer may also be used to reinforce the surface and provide greater tensile strength within the surface. The geotextile or similar layer may also provide a treatment layer for removal of contaminants such as hydrocarbons from the surface water. The geotextile or similar layer may also be used to moisten the upper synthetic surface layer by 'wicking' water, e.g. by capillary action, from the sub-surface support layer in to the upper synthetic surface layer.

If a geotextile or similar layer and/or a cushioning layer is provided between the structural module and the upper synthetic surface layer, then the size of the apertures in the top wall of the module may be increased slightly, compared to the case where no geotextile layer and/or a cushioning layer (or only one) is provided, provided that they still cause substantially no variation in the flatness of the synthetic surface layer.

Preferably an aggregate bedding layer is provided beneath the structural module. This aggregate layer can support the structural module and ideally also any associated load without significant movement. In addition, an aggregate layer can provide good drainage capabilities from the structural module. The aggregate layer can act as a levelling layer between an irregular formation beneath and the geotextile or similar layer and/or structural module above.

A geotextile or similar layer may be provided beneath the aggregate layer. This can prevent any silts and/or impurities in the earth beneath from passing up into the other layers of the surface, whilst allowing water to drain out from the surface into the earth beneath. The geotextile or similar layer may also be used to reinforce the formation and provide added strength to the surface. The geotextile or similar layer may also provide a treatment layer for removal of contaminants from the surface water such as hydrocarbons. The geotextile or similar layer may also be used to moisten the upper synthetic surface layer by 'wicking' water from the sub-surface support layer in to the upper synthetic surface layer.

A drainage layer may be provided beneath the structural module. If geotextile and/or aggregate layers are provided, then the drainage layer may be provided beneath these layers. The drainage layer can allow water to drain out of the layers into the ground beneath or into pipes through which the water can be transported out of the area. The drainage layer could be formed of particulate matter such as gravel and/or stones. The drainage layer could comprise a conduit or perforated pipe to allow the water to flow out of the area and/or to pass up into the sub-surface support layer from beneath where the sub-surface support layer is being used as part of a water management system for temporary attenuation of water, for example.

An impermeable membrane could be provided beneath the drainage layer. This would prevent water from passing into the ground beneath.

Alternatively, a water-permeable membrane may be provided beneath the drainage layer. This would allow water to pass out of the drainage layer into the ground beneath. The water-permeable membrane could contain or be formed from geotextile material, for example.

The geotextile layers that may be provided in the present invention could be made of geotextile fleece material and/or could comprise hydrophilic fibres. Preferably the components of the area are non bio-degradable in order to ensure longevity.

If more than one structural module is provided, some or all of the modules may be connected to other structural modules, for example by interlocking means provided on the sides of the structural modules, such as the means described in WO 02/14608.

The structural module may have a high water storage to volume ratio (e.g. 80%) and should be strong enough to support the surface above. The structural modules could be made of a suitable plastic, for example. In a preferred embodiment the modules are made from recycled plastic.

It is preferred that the structural module is of generally cuboid form so that it can tessellate with other modules. The top and bottom walls may be generally parallel. Opposite side walls may also be parallel.

One or more of the structural modules may contain a porous block for holding water. The porous block could be made of foamed polymeric material, for example. Such an arrangement is disclosed in WO 2009/030896, in respect of which there are inventors in common with those of the present invention.

The size of the module, and the size, location and geometry of any foamed polymeric material contained in the module can be determined by considering factors such as the average rainfall, temperature, wind speed, and humidity of the location where the surface is to be used, as well as the ideal moisture content of the upper surface layer for its intended purpose.

In general, a structural module may have a depth of about 60 mm, about 70 mm, about 80 mm, about 90 mm, about 100 mm, about 110 mm, about 120 mm, about 130 mm, about 140 mm, about 150 mm, about 175 mm, about 200 mm, about 225 mm, about 250 mm, about 275 mm, about 300 mm, about 325 mm, about 350 mm, or have a depth within any range whose lower limit is defined by one of those values and whose upper limit is defined by another of those values. Preferably the length and breadth dimensions of the structural module are both greater than the depth. A typical structural module in a preferred embodiment might have a length of between about 700 mm to about 720 mm, for example being about 710 mm; a breadth of from about 350 mm to about 360 mm, for example being about 355 mm; and a depth in the ranges set out above, for example being about 60 mm, about 120 mm or about 240 mm.

As regards the structure of the structural modules, preferably these are formed of moulded plastics material. In a preferred arrangement, each structural module is formed from a top half which includes a top wall and the upper part of a peripheral sidewall, and a bottom half defining a bottom wall and the lower part of the peripheral sidewall. The top and bottom halves may be fitted one inverted on top of the other. The top and bottom halves may each be provided with a set of half-pillars extending towards one another, the two sets of half-pillars co-operating with one another to form pillars extending between the top and bottom walls to resist vertical crushing of the structural module. The halves may be two similar integral plastics moulded components.

In an alternative module, the module is formed of a base part and a lid, where the base part comprises a bottom wall and side walls, and the lid forms the top wall. The lid may be fitted on top of the base part. The base part may be provided with a set of pillars extending upwards to the lid, the pillars extending between the lid and the bottom wall to resist vertical crushing of the structural module. The lid may have extending members arranged to fit into receiving portions on the base part and thereby prevent lateral movement of the lid over the base part, once they are fitted together. The base part and the lid may be integral plastics moulded components.

Preferably, the structural module further comprises a network of bracing members extending between the pillars within the structural module to resist deformation of the structural module in a horizontal plane. The walls and network may have one or more apertures formed therein to allow fluid flow both vertically and horizontally through the structural module.

It will be appreciated that the presence of a peripheral wall can be used to separate and support the top and bottom walls.

Although in the preferred embodiment the structural module is formed of plastics and is load bearing, it could be made of any other type of material that could support the loads expected in a particular environment, such as concrete, metal, wood, composite materials and so forth.

Many synthetic surfaces require the application of water to attain a specific water content suitable for playing on. Therefore, the area may also comprise means for transporting water from the structural modules up to the synthetic surface above. Such means could comprise pumps and channels or pipes, and/or the water could be transported by capillary action either through sufficiently thin tubes, or with suitable wicking means.

The area may also comprise heating means for heating the area. Preferably, such an area would also comprise a temperature sensor for measuring the temperature of the area. The temperature sensor could, for example, measure the temperature inside a structural module. Additional temperature sensors could be provided to ensure good coverage over the area. The heating means, together with a control system connected to the temperature sensor or sensors could prevent the temperature of the area, especially the temperature of the water in the area, from falling below a certain temperature such as 5° C., 4° C., 3° C., 2° C., 1° C. or 0° C., for example. Such a system would help to prevent the water in the area from freezing, and/or from frost developing on the upper surface layer.

The heating means could, for example, comprise means, such as a pipe, for circulating warm water and/or air through the area, in particular through or around the structural modules. The warm water could be pumped around the modules, or the air could be blown by fans.

In some locations, water applied to sports surfaces can contain water-borne diseases such as cholera or legionella. Therefore, in one embodiment of the invention, an additive may be included in the material forming the structural modules, for example, which kills such diseases. Alternatively, or in addition, the additive could be added to other parts of the area such as the cushioning layer, for example.

The area could be used in an outdoor or an indoor environment.

Although the present invention has been described in relation in particular to sports areas, it will be appreciated that whilst in accordance of the above aspects of the invention the area may also be used for other purposes, such a car park or an event arena.

Viewed from another aspect, the invention provides an area suitable for sporting activities comprising an upper synthetic surface layer, and a sub-surface support layer which includes a load bearing structural module, wherein the structural module comprises a top wall and a bottom wall spaced therefrom by one or more supporting elements so as to define a volume between the top and bottom walls, the top wall being provided with a plurality of apertures to permit the flow of liquid into and out of the volume, and the size and shape of the apertures being such that the aperture would let through a sphere only with a diameter of no greater than about 5 mm, or no greater than about 6 mm, or no greater than about 7 mm, or no greater than about 8 mm, or no greater than about 9 mm, or no greater than about 10 mm, or no greater than about 12 mm, or no greater than about 15 mm.

Preferably, the aperture will let through a sphere only with a diameter which is no greater than a specified diameter in the range of about of 5 mm to about 10 mm. The specified diameter could for example be any one of the diameter values in the range of 5 mm to 10 mm, in 0.5 mm increments, such as 5, 5.5, 6 mm . . . and all 0.5 mm incremental values to . . . 9, 9.5, and 10 mm.

In a preferred embodiment, a sphere with a diameter of about 7 mm could not fit through each aperture in the top wall.

Viewed from another aspect, the invention provides an area suitable for sporting activities comprising an upper synthetic surface layer, a cushioning layer comprising granular material, and a sub-surface support layer which includes a load bearing structural module, wherein the cushioning layer is located between the synthetic surface layer and the sub-surface support layer, and the structural module comprises a top wall and a bottom wall spaced therefrom by one or more supporting elements so as to define a volume between the top and bottom walls, the top wall being provided with a plurality of apertures to permit the flow of liquid into and out of the volume, and the size and shape of the apertures being such that the granular material in the cushioning layer cannot fit through the apertures.

The area of the present invention may be assembled at the location of use or, alternatively, a unit may be provided comprising an upper synthetic surface layer, and a sub-surface support layer which includes a load bearing structural module, wherein the structural module comprises a flat top wall and a bottom wall spaced therefrom by one or more supporting elements so as to define a volume between the top and bottom walls, the top wall being provided with a plurality of apertures to permit the flow of liquid into and out of the volume, and the size and shape of the apertures being such that the apertures cause substantially no variation in the flatness of the synthetic surface layer, wherein the unit can be connected to another unit with interlocking means.

Accordingly, an area can be built to a desired size comprising a number of such units. The units may be prefabricated at a factory or workshop, for example, and then transported to the site of the area, where the units are joined together by the interlocking means to form an area of a desired size.

Such an area may be permanent or temporary. If an area is temporary (for example for a day, a week, a month or any other period of time), the units can easily be disconnected from each other and removed from the site. The units may also then be reused at a further site to form another area, if desired.

The units could be of various sizes, but typically by way of example they could measure 1.4 m (length)×0.7 m (width)× 0.1 m (depth).

The units may be relatively lightweight and could have a mass of around 10 kg, for example. This light mass allows the units to be easily lifted, handled, transported and installed, without specialist tools or equipment being required.

It is not necessary to excavate an area before installation of the units. Subsequent importation of a granular sub-base and/or a natural or artificial surfacing is also not required as the units themselves provide sufficient components to form a suitable surface.

The size of the units is such that they may fit through a standard door opening, for example through a standard doorway or gate at the side of a house and a thus an area may be constructed without the need for construction equipment that would not ordinarily fit through a doorway or gate.

A further benefit of the present invention is its ability to meet industry sustainable drainage aims of providing source control drainage. Source control drainage guidance promotes the use of pervious paving to manage rainwater where it lands by allowing the water to penetrate through the upper surfacing into a sub-base layer that is capable of providing temporary storage of a storm event within it. An example of such guidance is The Town and Country Planning (General Permitted Development) (Amendment) (No. 2) (England) Order 2008 No. 2362, which prevents the changing of a water-pervious external area (e.g. a natural grass surface within the cartilage of a dwellinghouse) to an impervious surface that may be subsequently used, for example, as a car parking area. The present invention can provide a modular, pervious surface, trafficable by vehicles that is prefabricated and can be assembled easily without need of excavation or formation of a sub-base.

Viewed from another aspect, the present invention relates to a method of providing an area suitable for sporting activities. The method comprises providing an upper synthetic surface layer, and a sub-surface support layer which includes a load bearing structural module, wherein the structural module comprises a top wall and a bottom wall spaced therefrom by one or more supporting elements so as to define a volume between the top and bottom walls, the top wall being provided with a plurality of apertures to permit the flow of liquid into and out of the volume, and the size and shape of the apertures being such that the apertures cause substantially no variation in the flatness of the synthetic surface layer.

The method may also comprise providing any of the optional features of the area described above.

Some embodiments of the invention will now be described by way of example only and with reference to the accompanying drawings in which.

Referring now to FIGS. 1 to 12, a structural module is shown at 10 comprising a top wall 11, a bottom wall 12 and a peripheral wall 13 extending between the upper wall 11 and the bottom wall 12 to provide at least one side wall and in this example four side walls. The top wall 11, bottom wall 12 and peripheral wall 13 define a volume 14.

This module includes a porous block, as disclosed in WO 2009/030896. This structure is described below but it will be appreciated that the use of a block is optional in the context of the present invention.

Figure 2:
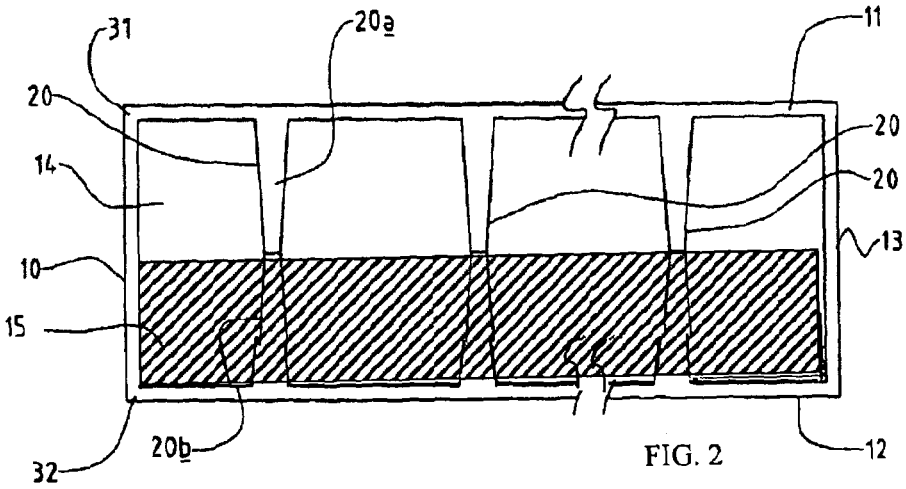
FIG. 2 is a section of FIG. 1.

In FIG. 2, located within the volume 14 is a porous rectangular block 15. The porous material in this case is a foamed phenol formaldehyde resin, such as that marketed by Smithers-Oasis under the trade mark OASIS™. The block 15 is fixed relative to the top wall 11, bottom wall 12 and peripheral wall 13 and in this case occupies the bottom part of the volume 14, extending upwards for approximately half of the height of the volume.

Figure 3:
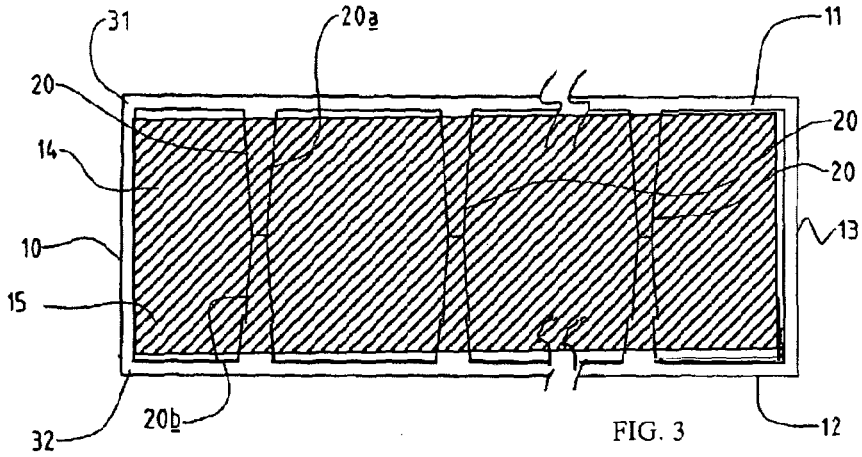
FIG. 3 is a section of FIG. 1, showing an alternative porous element.
Figure 4:
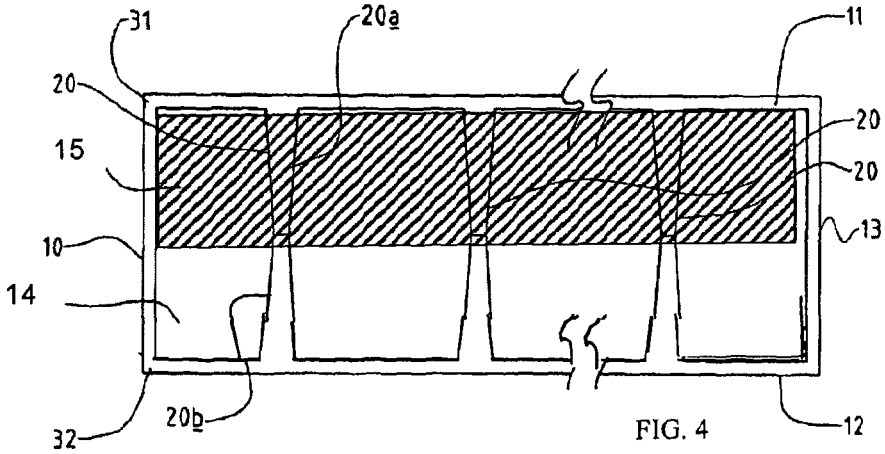
FIG. 4 is a section of FIG. 1, showing a further alternative porous element.

In FIG. 3 there is shown an alternative arrangement in which the block 15 occupies substantially all of the volume 14, and in FIG. 4 there is shown an alternative arrangement in which the block 15 occupies the top half of the volume 14.

Figure 1:
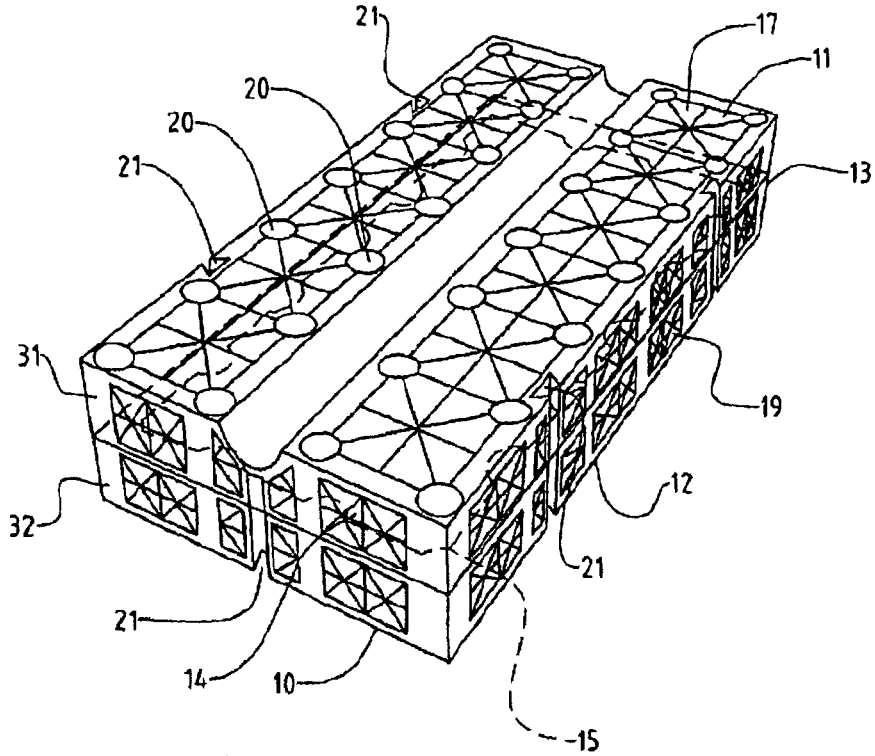
FIG. 1 is a perspective view of a structural module with a porous element.
Figure 6:
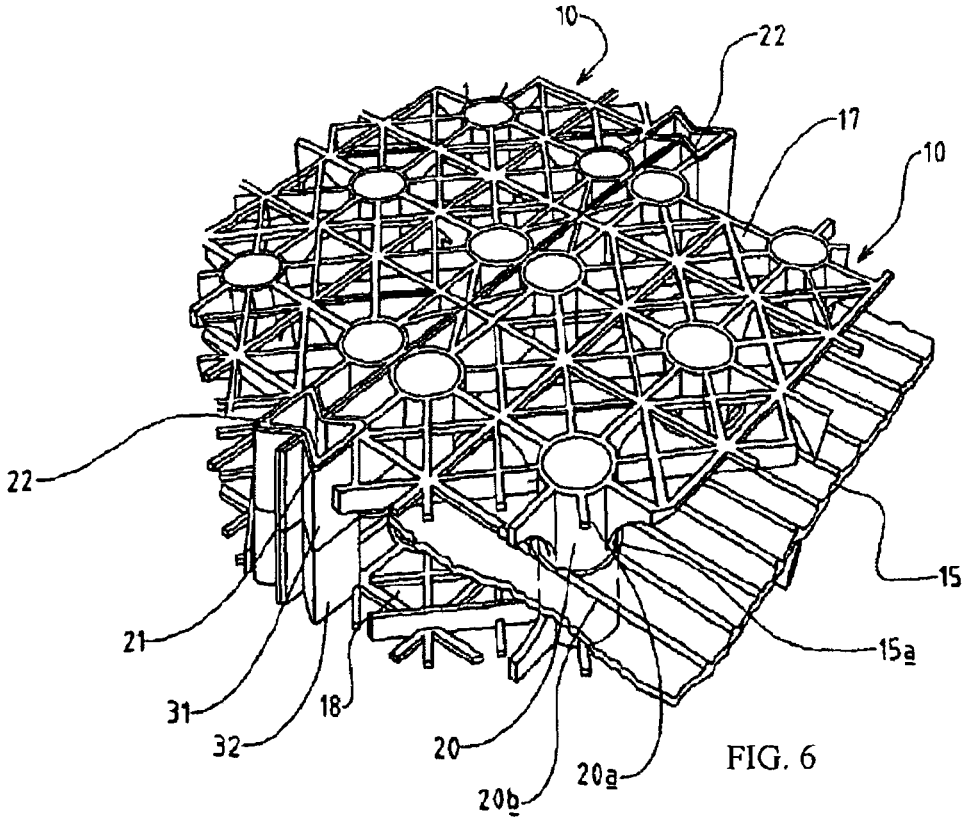
FIG. 6 is a broken away perspective view on a larger scale of part of two of the structural modules of FIG. 1 connected to one another.

As seen in FIGS. 1 and 6, the top wall 11, bottom wall 12 and peripheral wall 13 comprise a plurality of apertures 17, 18, 19 which, in this example, are generally triangular and are defined by a plurality of pillars forming the respective walls. The apertures 17, 18, 19 thus permit fluid to move in and out of the structural module 10.

The size and shape of each aperture in the top wall of the module is such that the aperture would let through a sphere only with a diameter of no greater than about 5 mm, or no greater than about 6 mm, or no greater than about 7 mm, or no greater than about 8 mm, or no greater than about 9 mm, or no greater than about 10 mm, or no greater than about 12 mm, or no greater than about 15 mm.

Preferably, the aperture will let through a sphere only with a diameter which is no greater than a specified diameter in the range of about of 5 mm to about 10 mm. The specified diameter could for example be any one of the diameter values in the range of 5 mm to 10 mm, in 0.5 mm increments, such as 5, 5.5, 6 mm . . . and all 0.5 mm incremental values to . . . 9, 9.5, and 10 mm.

Preferably, a sphere with a diameter of about 7 mm cannot fit through each aperture in the top wall.

In addition, the size and shape of each aperture in the top wall is such that granules in the shock pad placed on top of the module could not fit through the apertures.

Internally, in this example, the structural module 10 comprises a plurality of pillars 20 extending between the top wall 11 and the bottom wall 12. In the present example, the pillars are generally cylindrical and hollow and are distributed in a grid arrangement across the length and width of the structural module 10. The pillars 20 are sufficiently strong to resist crushing of the structural module 10 and thus enable the structural module 10 to support a desired vertical or lateral load depending on the environment in which the structural module 10 will be used.

To allow a plurality of structural modules 10 to be rigidly connected together, the structural module 10 is provided with a plurality of keyways 21 located in the ends of the sides thereof. In this example, each keyway 21 is a groove of a generally female dovetail shape in plan view for slidably receiving a tie member 22. As seen in FIG. 6, the tie members 22 are of "bow tie" cross section, comprising a pair of trapezoids joined together along their short parallel sides to be received in the keyways 21 of adjacent structural modules 10 to hold them together. As will be apparent, the generally rectangular shape of the structural modules 10 enables a plurality of structural modules 10 to be connected together to form an extensive, substantially continuous layer of structural modules 10 of any desired area.

Each structural module 10 may be formed in two parts which are connected together to form the structural module 10, where a porous block 15 can be introduced into the structural module prior to connecting the two parts together, if a porous block is required. Alternatively, the two parts can be connected together to form the structural module 10 without any porous block 15 being contained therein.

With reference to FIGS. 1 and 6, the structural module 10 may comprise a top part 31 which defines the top wall and part of the peripheral side wall and a bottom part 32 defining the bottom wall and the lower part of the peripheral side wall. The top part 31 and the bottom part 32 are each provided with a set of half-pillars 20*a*, 20*b* whereby the two sets of half-pillars, 20*a*, 20*b* engage one another to form the pillars 20 extending between the top wall 11 and the bottom wall 12. Preferably, the top part 31 and the bottom part 32 comprise similar plastic moulded components. The structural module 10 may be formed by inverting one component and placing it on top of the other, and, if required, introducing the porous block 15 into the volume prior to joining the two parts.

In some cases one or more structural modules which are not filled with foam can be used. Where foam is used, it need not be introduced as discussed above, but could be in the form of one or more blocks not shaped to the interior of the structural module, as loose material, or be injected as foam and cured in situ.

Figure 5:
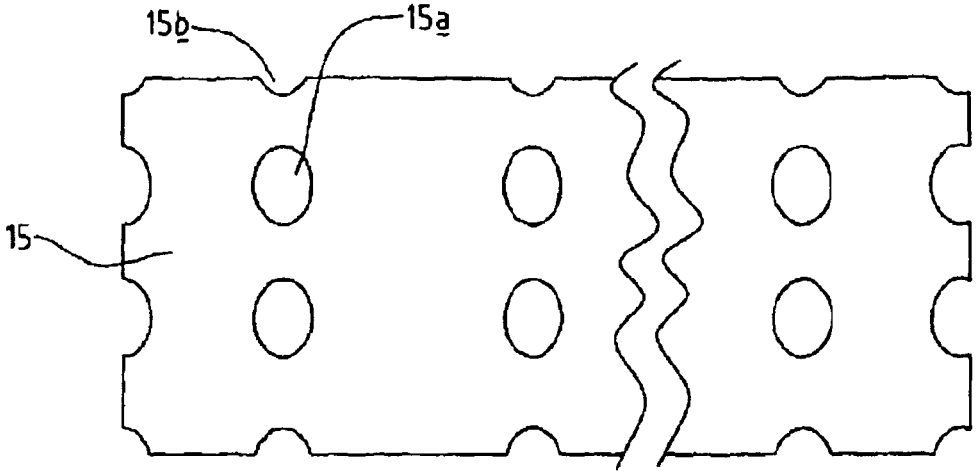
FIG. 5 is a plan view of the porous element of FIGS. 2, 3 and 4.

As seen in FIG. 5, since the structural module 10 is provided with pillars 20, the porous block 15 is provided with appropriate apertures 15*a* and/or cut outs 15*b* to receive the pillars 20. Such a configuration is advantageous in that the porous block 15 is constrained from substantial lateral movement by virtue of engagement of the pillars 20 in the apertures 15*a*, and is also constrained from vertical movement because the size of the apertures 15*a* is chosen so that there will be a reasonably tight fit with the pillars 20, thus locating the block firmly in the desired position in the structural module 10.

The structural module may have rigid top and bottom walls and rigid supporting elements, such as pillars or a sidewall, so that it can resist collapse under the loads to be encountered, which could for example include the weight of humans, animals, vehicles etc positioned or passing over the structural module. A preferred structural module has a short term vertical compressive strength of at least about 500 kN/m$^2$, more preferably at least about 650 kN/m$^2$, and more preferably at least about 700 kN/m$^2$. The short term vertical deflection is preferably less than about 2 mm/126 kN/m$^2$, and more preferably less than about 1.5 mm/126 kN/m$^2$, in a preferred arrangement being about 1 mm/126 kN/m$^2$.

A preferred module would meet the performance characteristics required by the governing bodies of the various sports and for example have a Peak G value typically equal to or less than 200 g when the head form is dropped from a height of 1 m and a force reduction value of typically 40-65% of the value achieved when the head form is dropped on concrete surface.

A structural module may be manufactured in a strong, rigid plastics material such as polypropylene copolymer.

The percentage of the volume of the structural module that is void space, ignoring the presence of a foam insert or the like, may be at least about 80%, at least about 85%, or at least about 90%. In one embodiment the void space is about 95%. For a structural module with top and bottom walls and a side wall enclosing a volume within the structural module, the percentage of surface area that is apertured is at least about 40%, at least about 45%, or at least about 50%. In an embodiment the percentage of surface area that is apertured is about 52%.

A structural module may have the following parameters:

Weight 3.00 kg

Dimensions:

Length 708 mm

Width 354 mm

Height 80 mm

Short Term Compressive Strength:

Vertical 715 kN/m$^2$

Lateral 156 kN/m$^2$

Short Term Deflection:

Vertical 1 mm per 126 kN/m$^2$

Lateral 1 mm per 15 kN/m$^2$

Ultimate tensile strength of a single joint 42.4 kN/m$^2$

Tensile strength of a single joint at 1% secant modulus 18.8 kN/m$^2$

Bending resistance of module 0.71 kNm

Bending resistance of single joint 0.16 kNm

Volumetric void ratio 95%

Average effective perforated surface area 52%

Structural modules may be connected together to form a layer by ties, such as tie members 22 discussed earlier. Structural modules may be connected vertically by tubular shear connectors which can fit into the open ends of the support pillars in the arrangement described earlier.

Figure 7:
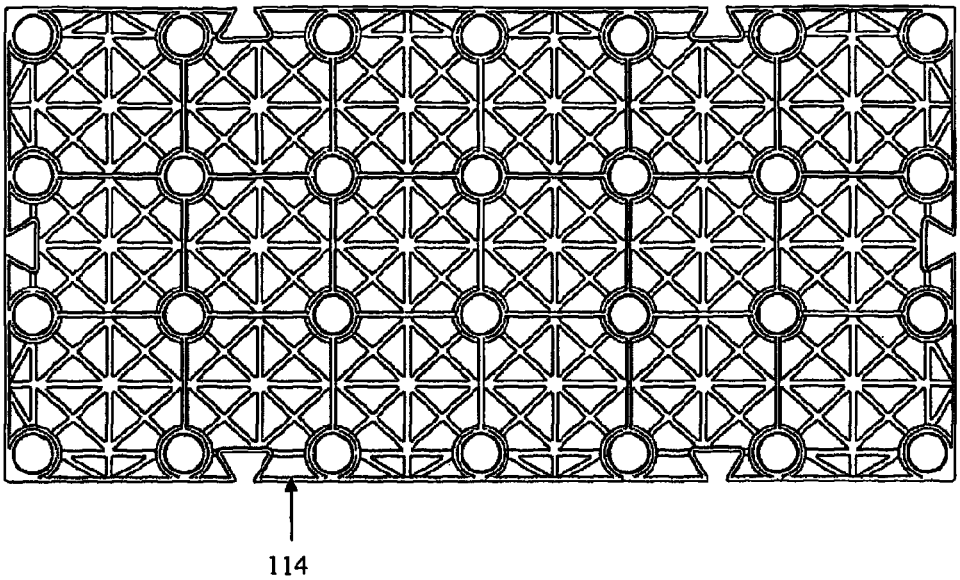
FIG. 7 is a plan view of another structural module.
Figure 8:
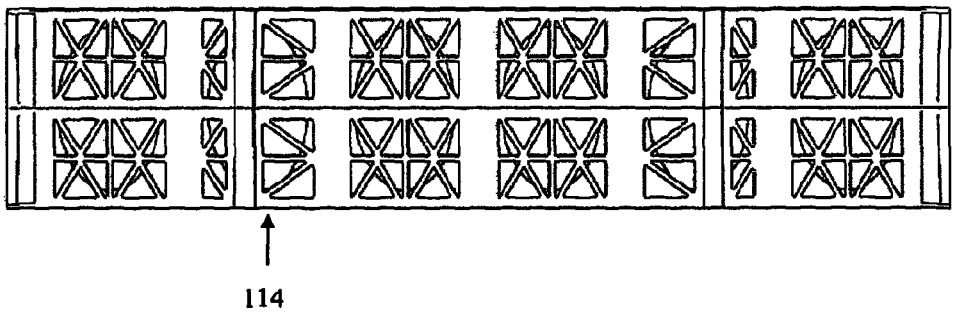
FIG. 8 is a front elevation of the structural module.
Figure 9:
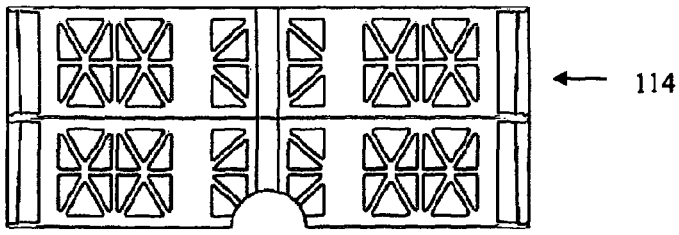
FIG. 9 is a side elevation of the structural module.
Figure 10:
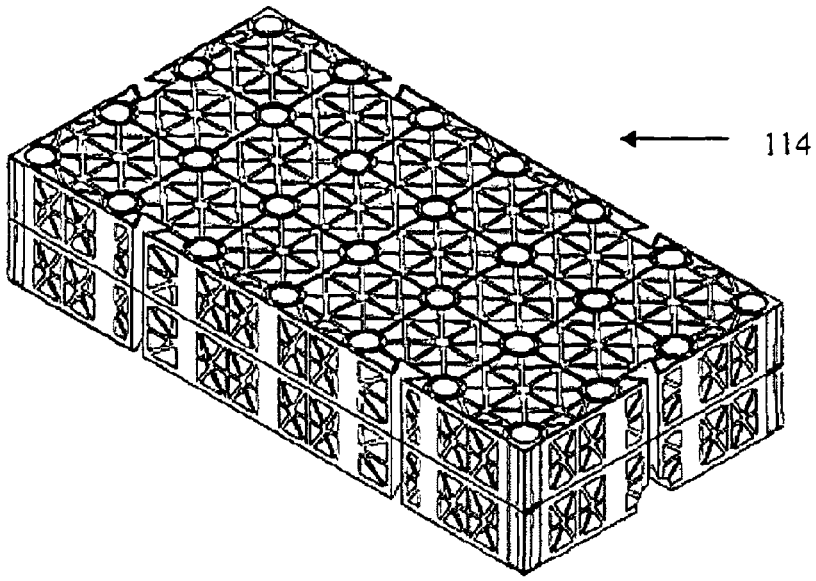
FIG. 10 is a perspective view of the structural module.

FIG. 7 is a plan view of a cuboid structural module 114, having the parameters set out above. FIG. 8 is a front elevation of the structural module, FIG. 9 is a side elevation of the structural module, and FIG. 10 is a perspective view of the structural module. As with the structural module 10 described with reference to FIGS. 1 to 6, this structural module 114 has been moulded in two halves which are then joined together.

The size and shape of each aperture in the top wall of the module 114 is such that the aperture would let through a sphere only with a diameter of no greater than about 5 mm, or no greater than about 6 mm, or no greater than about 7 mm, or no greater than about 8 mm, or no greater than about 9 mm, or no greater than about 10 mm, or no greater than about 12 mm, or no greater than about 15 mm.

Preferably, the aperture will let through a sphere only with a diameter which is no greater than a specified diameter in the range of about of 5 mm to about 10 mm. The specified diameter could for example be any one of the diameter values in the range of 5 mm to 10 mm, in 0.5 mm increments, such as 5, 5.5, 6 mm . . . and all 0.5 mm incremental values to . . . 9, 9.5, and 10 mm.

Preferably, a sphere with a diameter of about 7 mm cannot fit through each aperture in the top wall.

In addition, the size and shape of each aperture in the top wall is such that granules in the shock pad placed on top of the module could not fit through the apertures.

Figure 11:
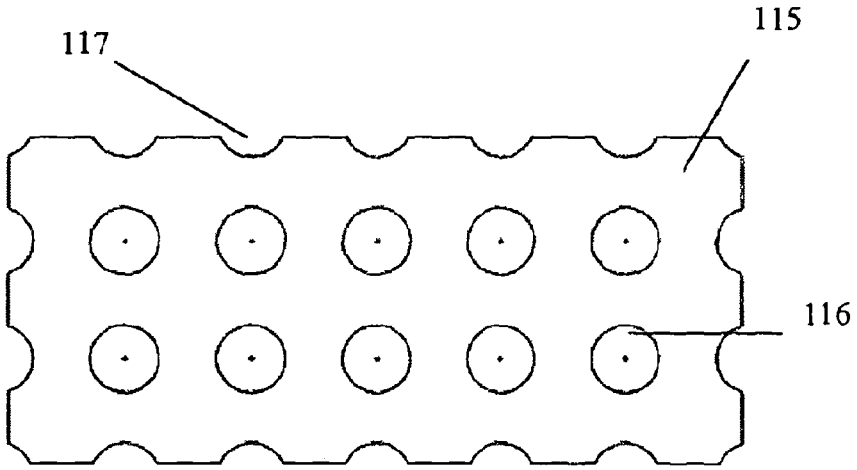
FIG. 11 is a plan view of a porous foam insert to be positioned in the structural module.

FIG. 11 is a plan view of a porous, water retentive, foamed polymeric insert 115 of OASIS™ foam to be used within the structural module 114, this having a thickness of about 75 mm so that it will occupy about one half only of the internal volume of the structural module. The interior of the structural module is provided with columns and the insert has apertures 116 and cut-outs 117 to accommodate these.

Figure 12:
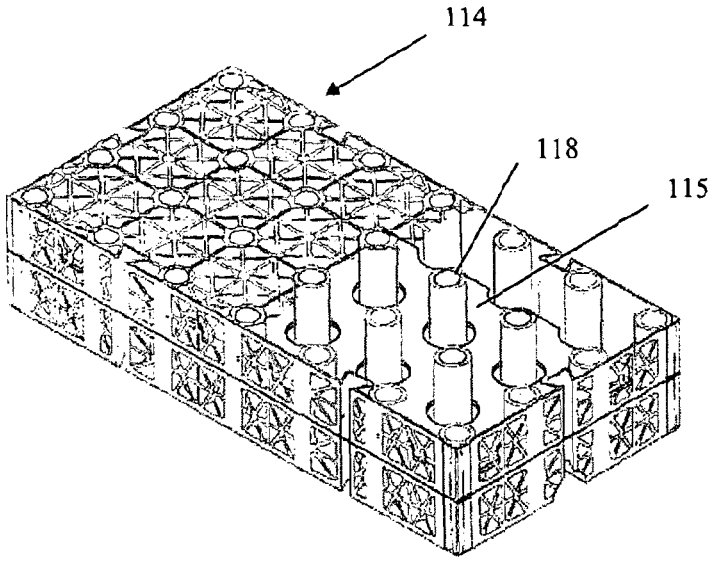
FIG. 12 is a perspective view of the structural module, partly cut away, showing the insert in place.
Figure 13:
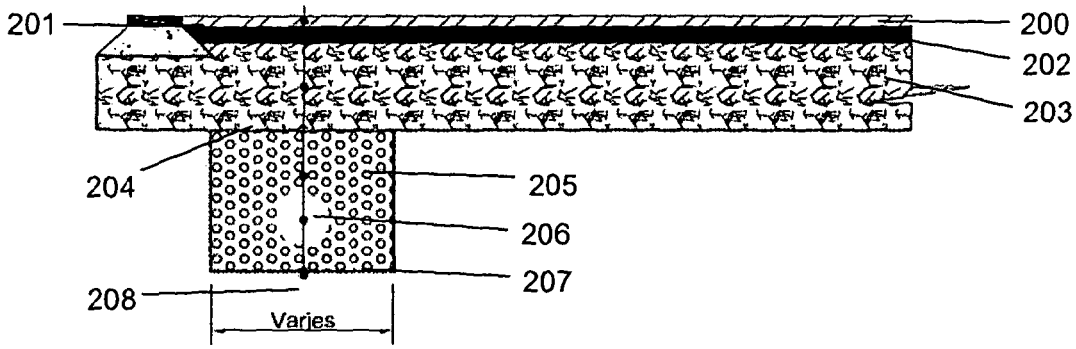
FIG. 13 is a cross-sectional view of a known artificial sports surface.
Figure 14:
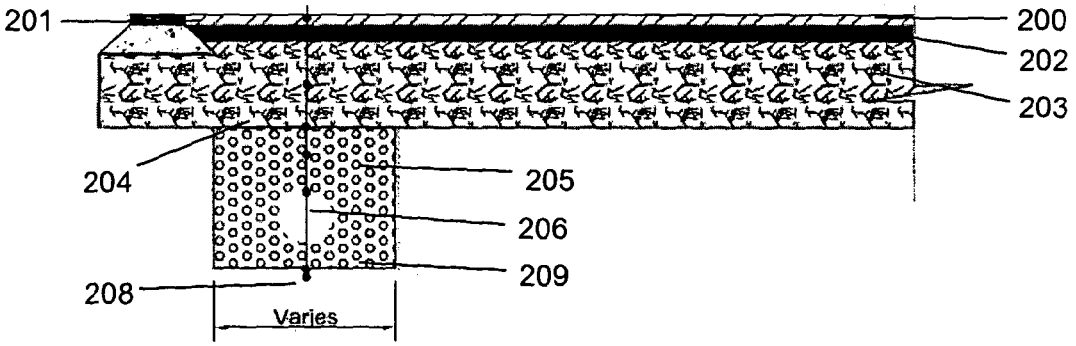
FIG. 14 is a cross-sectional view of another known artificial sports surface.

FIG. 12 shows the structural module 114 partly cut away, showing how the insert 115 has been positioned in the lower half of the structural module 114, with the apertures 116 and cut-outs 117 accommodating the supporting columns 118 within the structural module 114, in a manner equivalent to that discussed with reference to the structural module 10 of FIGS. 1 to 6.

In an alternative embodiment of the present invention, structural modules whose lower parts (i.e. everything apart from the top wall) are essentially as described above with reference to FIGS. 1 to 12 are used. However, in this alternative embodiment, an alternative top wall or lid is used where the apertures in the top wall have a size and shape such that the aperture causes substantially no variation in the flatness of a synthetic surface layer laid on top of the structural module.

Figure 17:
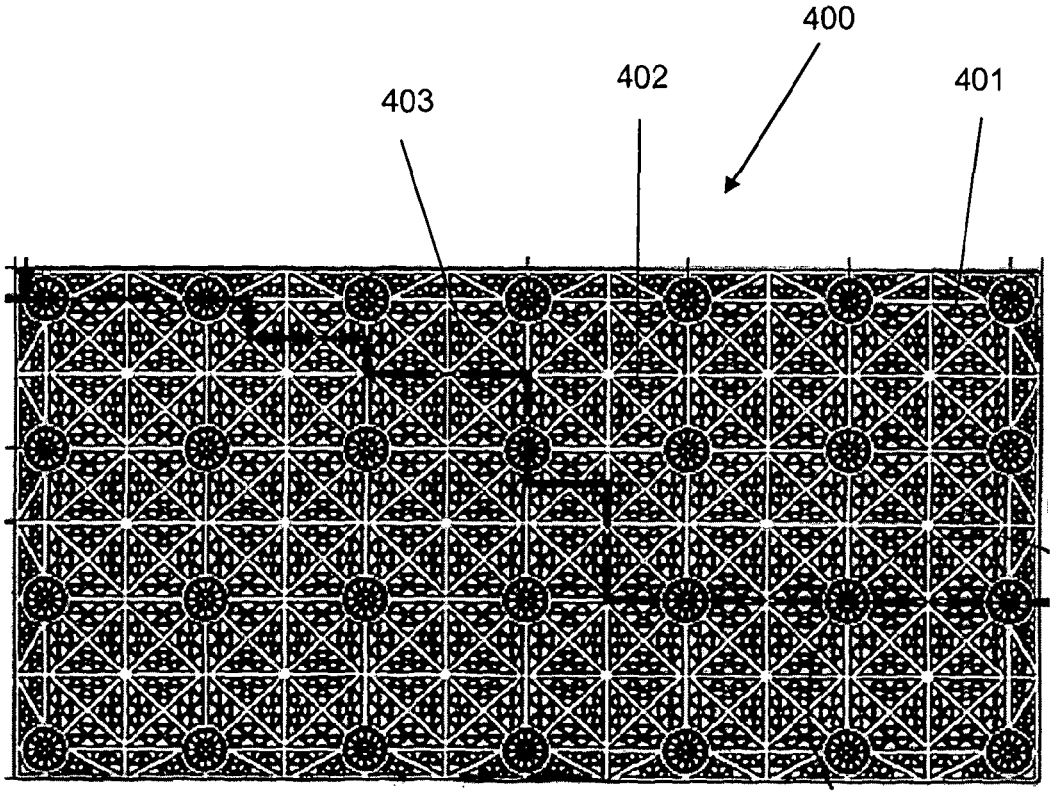
FIG. 17 is a top view of a preferred embodiment of a lid for a structural module for use in the present invention.
Figure 18:
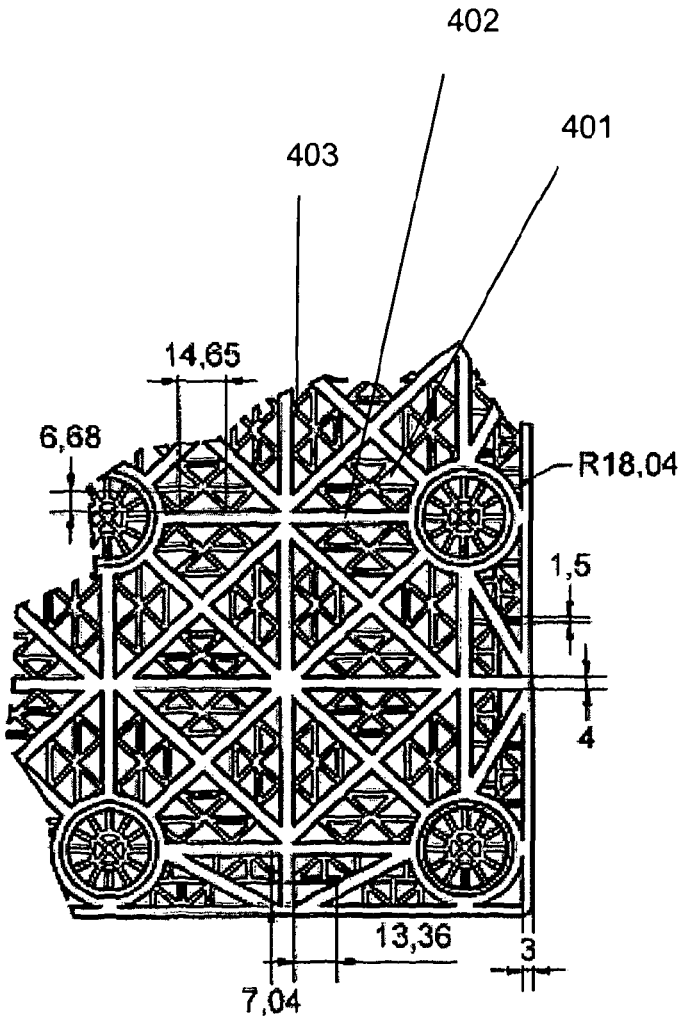
FIG. 18 is a magnified view of part of the lid shown in FIG. 17.
Figure 19:
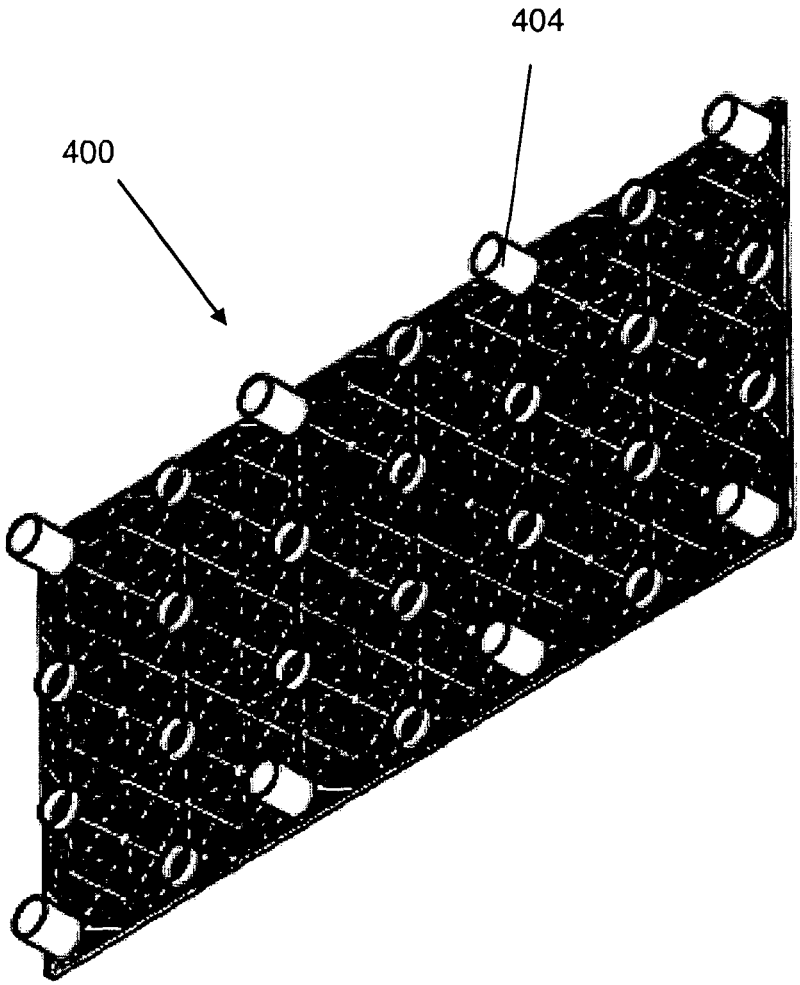
FIG. 19 is a perspective view showing the underside of the lid shown in FIGS. 17 and 18.
Figure 20:
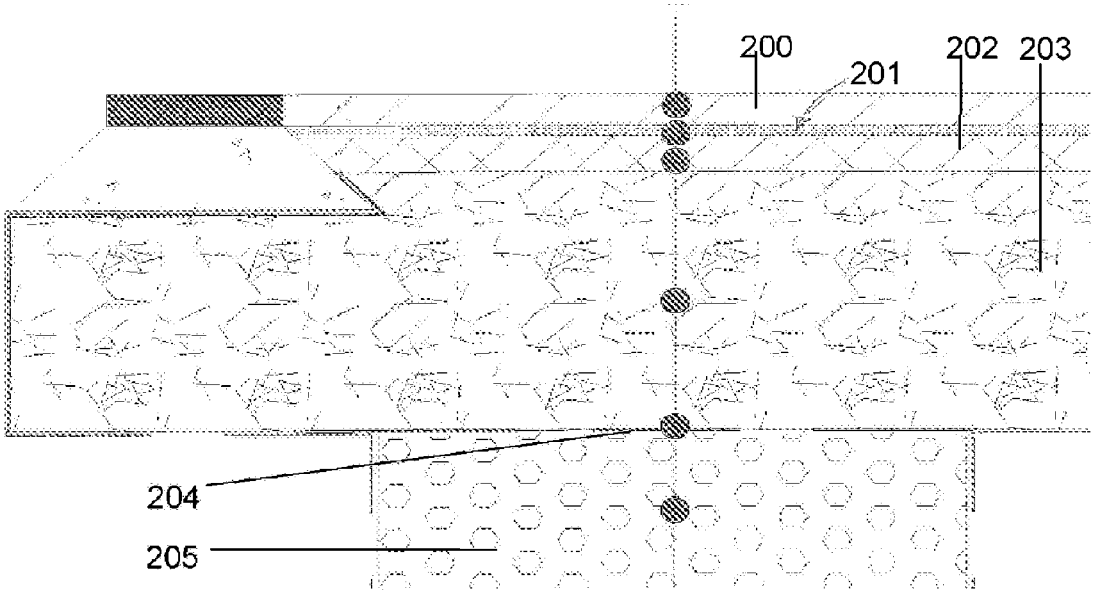
FIG. 20 is an enlarged view of part of the known artificial sports surface shown in FIG. 14.

FIGS. 17 to 19 illustrate a lid or top wall 400 for a structural module for use in this alternative embodiment of the present invention.

The lid 400 has a plurality of apertures 401 formed from a mesh-like structure of connected members 402, 403. The members may vary in thickness, the lid 400 having a smaller number of longer thicker members 402, and a larger number of shorter thinner members 403 arranged in the spaces between the long thick members 402. The thick members 402 in particular provide additional strength to the module.

The members 402, 403 define the apertures 401 which may have various shapes such as triangles, segments of a circle or other polygons.

The size and shape of every aperture in the lid 400 is such that the aperture causes substantially no variation in the flatness of the synthetic surface layer laid on top of the structural module.

As illustrated in FIG. 19, the underside of the lid 400 has a number of elongate members 404 which can be inserted into corresponding holes or receiving portions provided in a base or lower part of the module, which could be substantially as described with reference to FIGS. 1 to 12.

Such an arrangement means that already available base parts can be used with only the lid 400 requiring modification.

Figure 15:
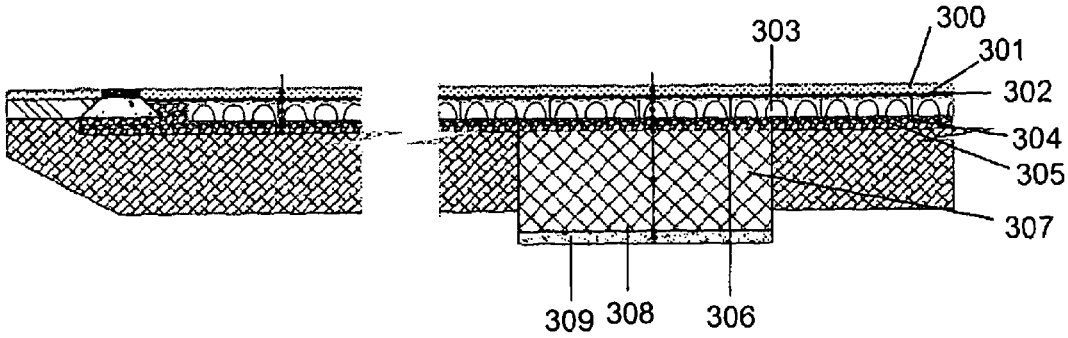
FIG. 15 is a cross-sectional view of a sports surface according to a preferred embodiment of the present invention.
Figure 16:
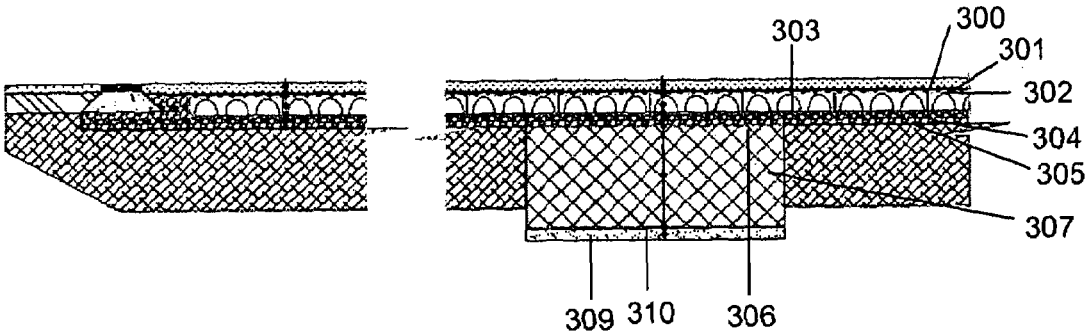
FIG. 16 is a cross-sectional view of a sports surface according to another preferred embodiment of the present invention.

FIGS. 15 and 16 illustrate preferred embodiments of an area according to the present invention.

The earth is prepared by levelling to form a prepared formation 309.

Above the formation 309 is provided either an impermeable membrane 308 (as shown in FIG. 15) or a permeable geotextile layer 310 (as shown in FIG. 16). The impermeable membrane 308 may be made from plastic or rubber, for example and prevents water from passing from the surface into the ground below. Conversely, the permeable geotextile layer 310 allows water to pass through it into the ground below. Depending on a situation's particular needs, either of these embodiments may be chosen.

Above the impermeable membrane 308 or geotextile layer 310 is provided a drainage layer 307 formed of gravel or stones, for example, and optionally containing a conduit or perforated pipe to transport water out of the area. Alternatively, the drainage layer 307 could be formed of structural modules, such as those described in the present application, or in WO 02/14608, for example.

Above the drainage layer 307 is provided a geotextile layer 306 followed by an aggregate bedding layer 305 and a further geotextile layer 304. Alternatively, in some parts of the area, the geotextile layer 306, the aggregate bedding layer 305 and the further geotextile layer 304 are located directly on top of prepared earth or ground.

Together, all of the layers described so far are arranged to form a flat base on which the layer of adjacent and/or interlocking structural modules 303 is located. The structural modules 303 could be as described with reference to any of FIG. 1-12 or 17-19 above.

A further geotextile layer 302, referred to as a geotextile scrim, may be provided above the structural modules 303. This is followed by a rubber shock pad 301 and then the synthetic grass layer 300.

The rubber shock pad 301 is formed of rubber granules (e.g. granules formed from old tyres) held together by a binder. The size of the apertures in the top wall of the structural modules 303 is such that the granules cannot fit through the apertures. The granules can sit in the apertures and thereby grip the modules.

Features of the invention can be expressed in various different ways, and for example the size and shape of each aperture in the top wall of the structural module may be such that the maximum diameter of sphere that the aperture would let through is in a range up to about 10 mm.

It will be expressed that the use of the word "sphere" does not imply that the module will be used in an environment where the module would be exposed to spheres of any type. It simply sets out a test for determining whether an aperture has the required properties, and the same test could be carried out with other objects having a circular profile, such as a cylinder. In practice, the apertures themselves need not be circular at all (and in some preferred embodiments the majority or substantially all are not circular). The apertures could be triangular, rectangular, hexagonal and so forth.

In some embodiments of the invention, the size and shape of each aperture in the top wall is such that the maximum diameter of sphere that the aperture would let through is about 9 mm; in some embodiments of the invention, the size and shape of each aperture in the top wall is such that the maximum diameter of sphere that the aperture would let through is about 8 mm; in some embodiments of the invention, the size and shape of each aperture in the top wall is such that the maximum diameter of sphere that the aperture would let through is about 7 mm; in some embodiments of the invention, the size and shape of each aperture in the top wall is such that the maximum diameter of sphere that the aperture would let through is about 6 mm; in some embodiments of the invention, the size and shape of each aperture in the top wall is such that the maximum diameter of sphere that the aperture would let through is about 5 mm.

In some embodiments of the invention, the arrangement is such that the maximum diameter of sphere that the apertures in the top wall would let through is a specified value in a range of from about 5 mm to about 10 mm. The specified value could for example be about any one of the values in the range of 5 mm to 10 mm, in 0.5 mm or other increments, such as 5, 5.5, 6, 6.5, 7, 7.5, 8, 8.5, 9, 9.5 and 10 mm, or 5, 5.1, 5.2 . . . 9.9, 10 mm.

As regards the sizes and shapes of the apertures, it will be appreciated that references to a sphere means a substantially incompressible sphere. Such references could also be replaced in some instances by a reference to other objects of circular cross section. When considering particles which may be allowed to sit in an aperture without passing through, the use of a sphere to define the aperture size and shape may be considered more appropriate as a sphere of an appropriate size can sit in an aperture without passing through, whereas a cylinder cannot and will either pass through fully, or not at all.

The invention claimed is:

1. An area suitable for sporting activities, comprising an upper synthetic surface layer, and a sub-surface support layer which includes a load bearing structural module, wherein the structural module comprises a top wall and a bottom wall spaced therefrom by one or more supporting elements so as to define a volume between the top and bottom walls, the top wall being provided with a plurality of apertures to permit the flow of liquid into and out of the volume, and the size and shape of the apertures being such that the apertures cause substantially no variation in the flatness of the synthetic surface layer, and the bottom wall is provided with a plurality of apertures which are relatively large compared to the apertures of the top wall, the size and shape of the apertures in the bottom wall being such that a sphere with a diameter which exceeds a maximum diameter allowable for spheres to be able to pass through the apertures in the top wall will be able to pass through the apertures in the bottom wall.

2. The area of claim 1, wherein the size and shape of each aperture in the top wall is such that the aperture would let through a sphere only with a diameter of no greater than about 5 mm, or no greater than about 6 mm, or no greater than about 7 mm, or no greater than about 8 mm, or no greater than about 9 mm, or no greater than about 10 mm, or no greater than about 12 mm, or no greater than about 15 mm.

3. The area of claim 1, wherein at least one of the at least one apertures in the top wall is triangular.

4. The area as claimed in claim 1, wherein an aperture to surface ratio of the top wall is at least 40%, 50%, 55%, 60%, 65%, 70%, 75%, 80%, 85% or 95%.

5. The area of claim 1, wherein a cushioning layer is provided between the upper synthetic layer and the sub-surface support layer.

6. The area of claim 1, wherein the bottom wall of the module has at least one aperture to permit the flow of liquid therethrough.

7. The area of claim 1, wherein the module comprises at least one side wall having at least one aperture to permit the flow of liquid therethrough.

8. The area of claim 1, wherein a geotextile layer is provided above and/or below the structural module.

9. The area of claim 1, wherein an aggregate layer is provided beneath the structural module.

10. The area of claim 9, wherein a geotextile layer is provided beneath the aggregate layer.

11. The area of claim 1, wherein a drainage layer is provided beneath the structural module and any geotextile and/or aggregate layer provided beneath the structural module.

12. The area of claim 11, wherein the drainage layer contains a conduit, a perforated pipe, and/or particulate matter.

13. The area of claim 11, wherein an impermeable membrane is provided beneath the drainage layer.

14. The area of claim 11, wherein a water-permeable membrane is provided beneath the drainage layer.

15. The area of claim 14, wherein the water-permeable membrane contains or is formed from geotextile material.

16. Use of an area as claimed in claim 1 for sporting activities.

17. A method of providing an area suitable for sporting activities, comprising the step of providing an upper synthetic surface layer, and a sub-surface support layer which includes a load bearing structural module, wherein the structural module comprises a top wall and a bottom wall spaced therefrom by one or more supporting elements so as to define a volume between the top and bottom walls, the top wall being provided with a plurality of apertures to permit the flow of liquid into and out of the volume, and the size and shape of the apertures being such that the apertures cause substantially no variation in the flatness of the synthetic surface layer, and the bottom wall is provided with a plurality of apertures which are relatively large compared to the apertures of the top wall, the size and shape of the apertures in the bottom wall being such that a sphere with a diameter which exceeds a maximum diameter allowable for spheres to be able to pass through the apertures in the top wall will be able to pass through the apertures in the bottom wall.

18. The method of claim 17, wherein the size and shape of each aperture in the top wall is such that the aperture would let through a sphere only with a diameter of no greater than about 5 mm, or no greater than about 6 mm, or no greater than about 7 mm, or no greater than about 8 mm, or no greater than about 9 mm, or no greater than about 10 mm, or no greater than about 12 mm, or no greater than about 15 mm.

19. The method of claim 17, comprising the step of providing a cushioning layer between the upper synthetic layer and the sub-surface support layer.

20. The method of claim 17, comprising the step of providing a geotextile layer above and/or below the structural module.

21. The method of claim 17, comprising the step of providing an aggregate layer beneath the structural module.

22. The method of claim 17, comprising the step of providing a geotextile layer beneath the aggregate layer.

23. The method of claim 17, comprising the step of providing a drainage layer beneath the structural module and any geotextile and/or aggregate layer provided beneath the structural module.

24. The method of claim 17, comprising the step of providing an impermeable membrane beneath the drainage layer.

25. The method of claim 17, comprising the step of providing a water-permeable membrane beneath the drainage layer.

* * * * *